US005856835A

United States Patent [19]

Umeda et al.

[11] Patent Number: 5,856,835

[45] Date of Patent: Jan. 5, 1999

[54] INK JET PRINT RECORDING APPARATUS HAVING A SINGLE SENSOR CONTROLLING PAPER FEED AND PRINT HEAD RECOVERY

[75] Inventors: Takaichiro Umeda; Hiroyuki Kato, both of Nagoya, Japan

[73] Assignee: Brother Kogyo Kabushiki Kaisha, Nagoya, Japan

[21] Appl. No.: 573,061

[22] Filed: Dec. 15, 1995

[30] Foreign Application Priority Data

Jan. 9, 1995 [JP] Japan ..... 7-018588

[51] Int. Cl.[6] ..... B41J 2/165

[52] U.S. Cl. ..... 347/23

[58] Field of Search ..... 347/23, 22, 30; 400/55

[56] References Cited

U.S. PATENT DOCUMENTS 4,883,375 11/1989 Karube et al. ..... 400/55

5,193,918 3/1993 Lohrmann et al. ..... 400/56

5,322,377 6/1994 Asai ..... 400/55

5,689,293 11/1997 Hirano ..... 347/33

*Primary Examiner*—Shawn Riley

*Attorney, Agent, or Firm*—Oliff & Berridge, PLC

[57] ABSTRACT

In an ink jet type print recording apparatus, when a purge gear is driven and a purge pump arrives at its origin position, an origin mark of a pump cam gear presses a cam receiver of a first actuator so that a movement transmitting portion of the first actuator presses a movement receiving portion of a second actuator. With this operation, a shutter of the second actuator is moved out of a common sensor and the common sensor is switched on. Furthermore, when a print sheet is supplied to a platen roller, a sheet detector of the second actuator is pressed by the print sheet, whereby the shutter is moved out of the common sensor and the common sensor is switched on. Various operations are performed on the basis of signals from the common sensor.

19 Claims, 10 Drawing Sheets

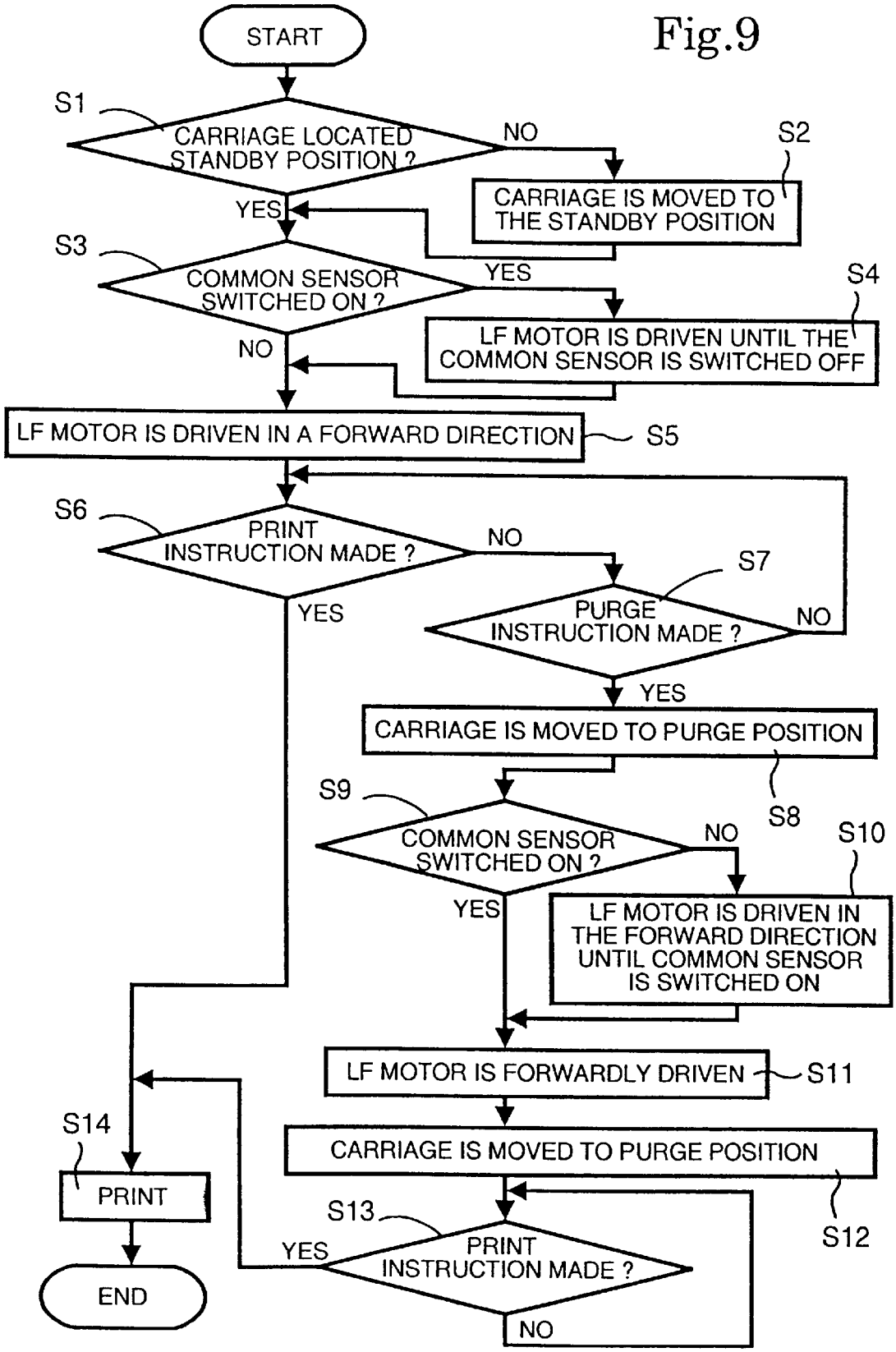
Fig.9
START
S1
CARRIAGE LOCATED STANDBY POSITION ?
NO
S2
CARRIAGE IS MOVED TO THE STANDBY POSITION
YES
S3
COMMON SENSOR SWITCHED ON ?
YES
S4
LF MOTOR IS DRIVEN UNTIL THE COMMON SENSOR IS SWITCHED OFF
NO
LF MOTOR IS DRIVEN IN A FORWARD DIRECTION
S5
S6
PRINT INSTRUCTION MADE ?
NO
S7
PURGE INSTRUCTION MADE ?
NO
YES
YES
CARRIAGE IS MOVED TO PURGE POSITION
S8
S9
COMMON SENSOR SWITCHED ON ?
NO
S10
LF MOTOR IS DRIVEN IN THE FORWARD DIRECTION UNTIL COMMON SENSOR IS SWITCHED ON
YES
LF MOTOR IS FORWARDLY DRIVEN
S11
CARRIAGE IS MOVED TO PURGE POSITION
S12
S13
PRINT INSTRUCTION MADE ?
YES
NO
S14
PRINT
END Fig.10
RELATED ART
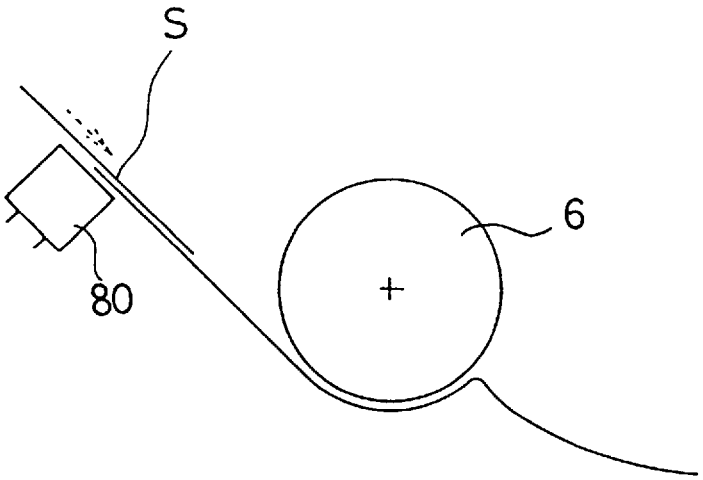
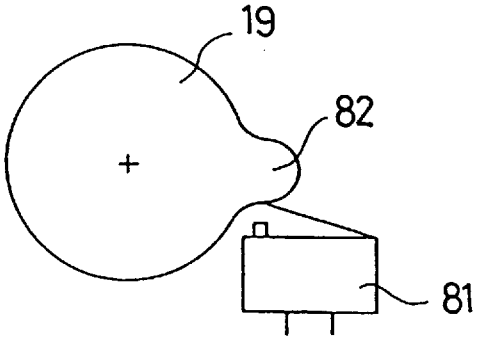

INK JET PRINT RECORDING APPARATUS HAVING A SINGLE SENSOR CONTROLLING PAPER FEED AND PRINT HEAD RECOVERY

BACKGROUND OF THE INVENTION

1. Field of the Invention

The invention relates to an ink jet print recording apparatus having an ink jet print head mounted thereon, and particularly to an ink jet print recording apparatus in which detection of a print medium and detection of an origin of a suction pump for sucking and discharging ink from the print head to recover, or clean, the print head are performed using a common sensor.

2. Description of Related Art

A print recording apparatus, such as a copying machine, a facsimile machine, or a printer for a personal computer, in which a dot pattern image is formed on a print medium, such as a paper sheet or a plastic sheet, on the basis of transferred print information is known. One type of print head known for use with such an apparatus is an ink jet print head for jetting small ink droplets from an ink discharge port (nozzle) onto the print medium to perform the print operation.

With this type of ink jetting print head, bubbles sometimes occur in the ink stored in the print head during use which causes a failure in ink jetting. Further, there are also cases where the ink droplets, dried ink or other foreign matter, such as sheet powder, attach to and clog the ink discharge port so that the ink discharging operation is liable to fail.

In order to avoid such problems, removal of the cause of the ink jetting failure and return of the print head to a good ink jetting state must be periodically performed. To do this, a purge operation comprising the sucking of defective ink to remove foreign matter from the ink discharge face is periodically carried out. A suction pump for producing a negative pressure for the purge operation and a driving motor for driving the suction pump are provided for this purpose. In order to control the ink suction quantity of the suction pump with high precision, a sensor for detecting the origin position of the suction pump is provided to carry out a motor driving operation corresponding to a single suction operation on the basis of a signal from the sensor.

In this type of print recording apparatus, many print media (sheets) of a predetermined size are stacked on a feed cassette and fed to a platen roller one by one for the print operation. Therefore, as shown in FIG. 10, a sheet sensor 80 for detecting a print sheet S supplied from the feed cassette is provided. The platen roller 6 and the print head are driven on the basis of a signal from the sheet sensor 80. A discharge operation of a printed sheet is also performed on the basis of the signal from the sheet sensor 80. Separate from the sheet sensor 80, a pump origin sensor 81 is provided which is switched on by a projection 82 of a pump cam 19 to detect the origin of the pump.

In this type of print recording apparatus, a driving motor (not shown) is used for driving both the platen roller 6 and the suction pump (not shown) and a switching operation of the driving motor is carried out by a link gear to control what is driven. A motor is heavy so that as the number of motors increase, the total weight and overall size of the apparatus also increases which is undesirable.

Specifically, the platen roller 6 is linked to the driving motor at all times and the suction pump is separated from the driving motor except during the purge operation. This is because the suction pump will be damaged, due to a counterflow of ink, if it is reversely rotated as the platen roller 6 is reversely rotated to position the leading edge of a print sheet.

As described above, in the conventional print recording apparatus, the sheet sensor 80 and the pump origin sensor 81 are separately provided driving costs up. Further, although a driving motor is commonly used for the suction pump and the platen roller, a sensor is not commonly used and thus the advantage of the common use of the driving motor cannot be sufficiently enhanced.

As described above, the suction pump is driven by the driving motor only as necessary, and it is not driven at the same time when the platen roller 6 is rotated to start a sheet feed operation. Accordingly, the sheet sensor 80 and the pump origin sensor 81 are not switched on at the same time.

SUMMARY OF THE INVENTION

After noting the above, the inventors believed a sensor could be commonly used as the sheet sensor and the pump origin sensor. However, the detection target (suction pump or print sheet) of the sensor is not identifiable when the sensor is switched on. Therefore, the common use of such a sensor has not yet been realized.

Thus, the object of the invention is to provide an ink jet type print recording apparatus in which detection of the origin of a suction pump and detection of a print sheet are performed using a single sensor, and a current target of the sensor (a target which causes the sensor to be switched on) is identified on the basis of the position of a carriage to thereby reduce the number of sensors and the cost of the print recording apparatus.

In order to attain the above object, according to the invention, an ink jet type print recording apparatus which has an ink jet type print head for jetting ink from an ink discharge port onto a print medium, a feeding roller for feeding the print medium, a carriage which is equipped with the print head and is movable in parallel to the feeding roller, carriage position judging means for judging the position of the carriage, recovery means for sucking the ink from the ink discharge port of the print head to recover the print head, and a driving motor for driving the feeding roller and the recovery means, comprises driving switching means for linking the driving motor to the recovery means when the carriage is moved to a recovery position at which the recovery means performs a recovery operation on the print head and separating the driving motor and the recovery means from each other when the carriage is moved away from the recovery position, a sensor for generating reference signals for a recovery operation of the print head and a print medium feeding operation of the feeding roller, a first transmission member for switching on the sensor when the recovery means is located at the origin position, a second transmission member for switching on the sensor through the print medium when the print medium is supplied to the feeding roller, recovery control means for actuating the driving motor on the basis of a signal from the sensor which is switched on by the first transmission member when the carriage is located at the recovery position, thereby performing the recovery operation of the print head, and print control means for actuating the driving motor and the print head on the basis of a signal from the sensor which is switched on by the second transmission member when the carriage is located at a print position at which the print medium is printed.

The ink jet type print recording apparatus as described above may be provided with sheet discharge control means for actuating the driving motor until the signal from the sensor is off to discharge the print medium from the feeding roller when the carriage is moved to a standby position at which the carriage waits for an instruction.

According to the ink jet type print recording apparatus thus structured, when the carriage is moved to the recovery position, the driving motor and the recovery means are linked to each other by the driving switching means. Thereafter, the driving motor is actuated until the recovery means is moved to the origin position and the sensor is switched on through the first transmission member. At this time, since it is judged by the carriage position judging means that the carriage is located at the position at which the recovery operation is carried out, the on signal of the sensor is effective, and the origin position of the recovery means is identified. On the basis of the origin position thus identified, the driving motor is further driven by a predetermined amount by the recovery control means. Thereafter, the ink is sucked from the ink discharge port of the print head by the recovery means, and the ink discharge function of the print head is recovered. On the other hand, when the carriage is located at the print position, upon switch-on of the sensor through the second transmission member, a print operation is carried out.

Furthermore, according to the ink jet type print recording apparatus of the invention, when the carriage is moved to the standby position, the driving motor may be actuated by the sheet discharge control means until the print medium is passed through the second transmission member and the sensor is switched off by the second transmission member, thereby discharging the print medium from the feeding roller. At this time, the driving motor and the recovery means are separated from each other by the driving switching means, so that the recovery means is not driven.

As described above, according to the invention, the recovery means is linked to the driving motor only when the carriage is located at the recovery position and, at this time, the recovery means is driven. When the recovery means is moved to the origin position, the sensor is switched on by the first transmission member, and a predetermined recovery operation is carried out on the basis of the switch-on of the sensor. Therefore, when the carriage is located at a position other than the recovery position, the recovery means is not driven and the recovery operation is carried out with high precision at all times. Furthermore, when the print operation is carried out, the feeding roller is driven on the basis of the on-signal of the sensor which is supplied in response to the supply of the print medium, thereby performing the print operation with high position precision.

Furthermore, when the carriage is moved to the standby position, the driving motor is actuated until the on-signal of the sensor is released through the second transmission member by the print medium. Therefore, the printed print medium (sheet) is surely discharged before the carriage is moved to the recovery position, and thus the printed medium is prevented from being unintentionally moved during the recovery operation of the recovery means.

As described above, the recovery operation of the recovery means and the feeding operation of the print medium are controlled by a single sensor, so that the number of sensors can be reduced and thus the cost can be reduced without degrading the utility of the print recording apparatus.

BRIEF DESCRIPTION OF THE DRAWINGS

A preferred embodiment of the invention will be described in detail with reference to the following figures in which:

FIG. 9 is a flowchart for a control routine of the ink jet printer; and

FIG. 10 is a simplified portrayal of an arrangement of sensors of a conventional apparatus.

DETAILED DESCRIPTION OF PREFERRED EMBODIMENT

A preferred embodiment according to the invention will be described hereunder with reference to the accompanying drawings. The invention will be described in the context of an ink jet type print recording apparatus which is used while connected to a print instruction device, such as a personal computer.

The structure of the ink jet printer according to an embodiment of the invention will be described with reference to FIGS. 1 to 4.

Figure 1:
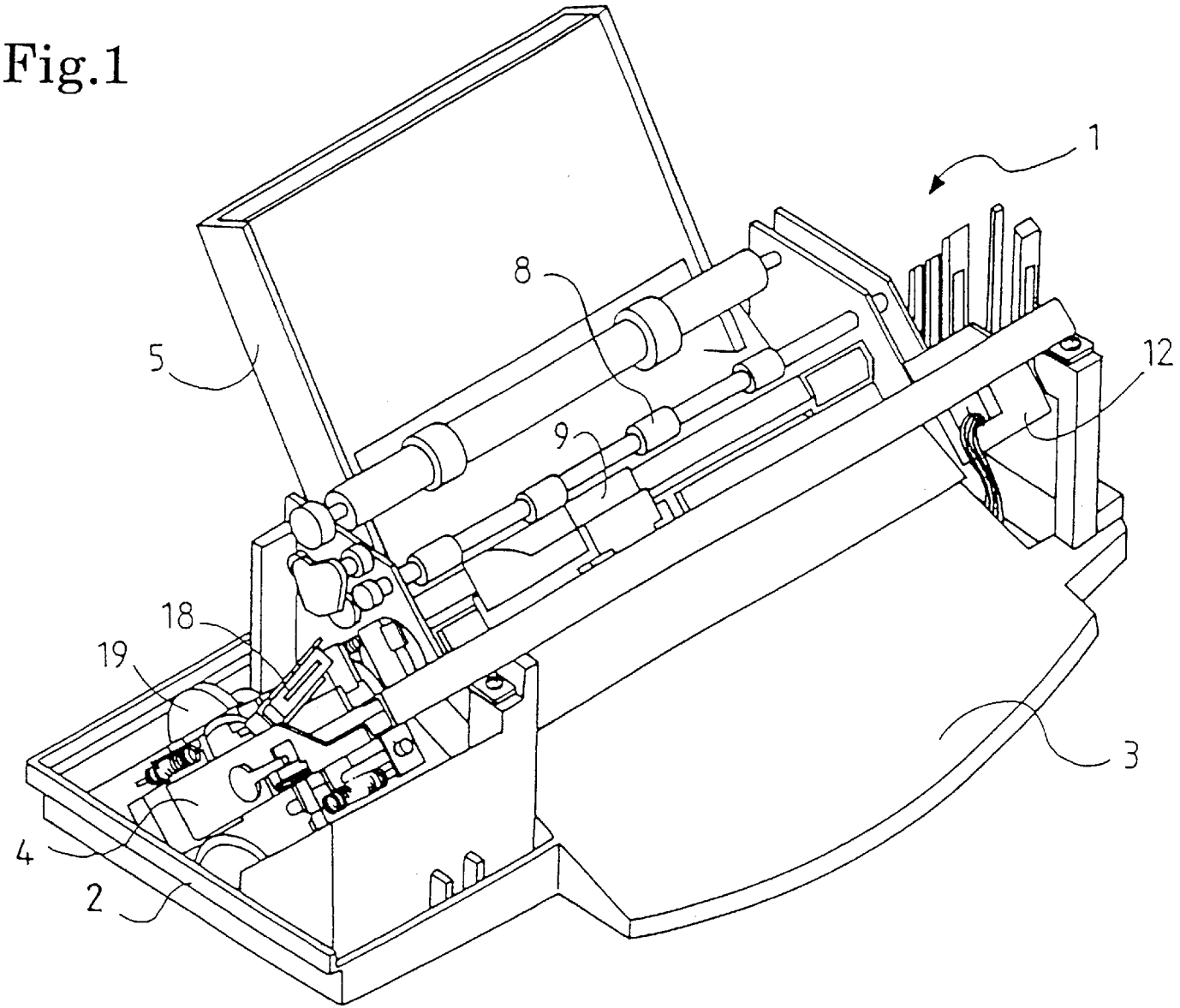
FIG. 1 is a perspective view showing the outline of an ink jet print according to an embodiment of the invention.

In FIG. 1, a manual sheet supply portion 3 is provided in front of a main body frame 2 of the ink jet printer 1, and a subframe 4 containing a print head 10, a purge mechanism 32 and a sheet feeding mechanism LM is mounted at the rear side of the manual sheet supply portion 3 and at the upper side of the main body frame 2 (all directions are from the perspective of an operator facing the print recording apparatus). Detachably mounted at the upper and rear side of the subframe 4 is a sheet supply cassette 5 in which plural print sheets are stocked.

Figure 2:
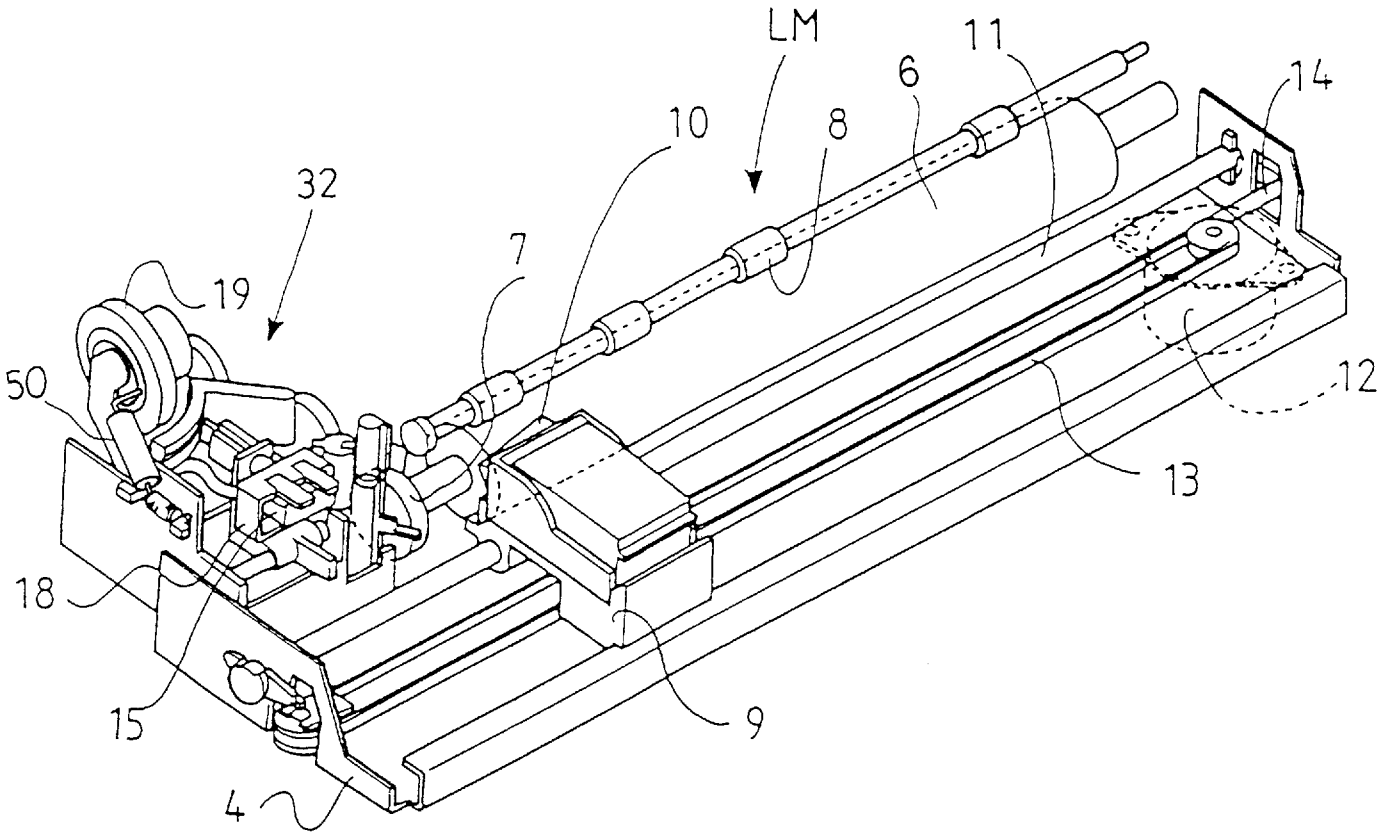
FIG. 2 is a perspective view showing a purge mechanism and a sheet feeding mechanism of the ink jet printer shown in FIG. 1.

FIG. 2 is a perspective view showing the subframe 4, and the print head 10, the purge mechanism 32, and the sheet feeding mechanism LM, which are contained in the subframe 4.

Figure 4:
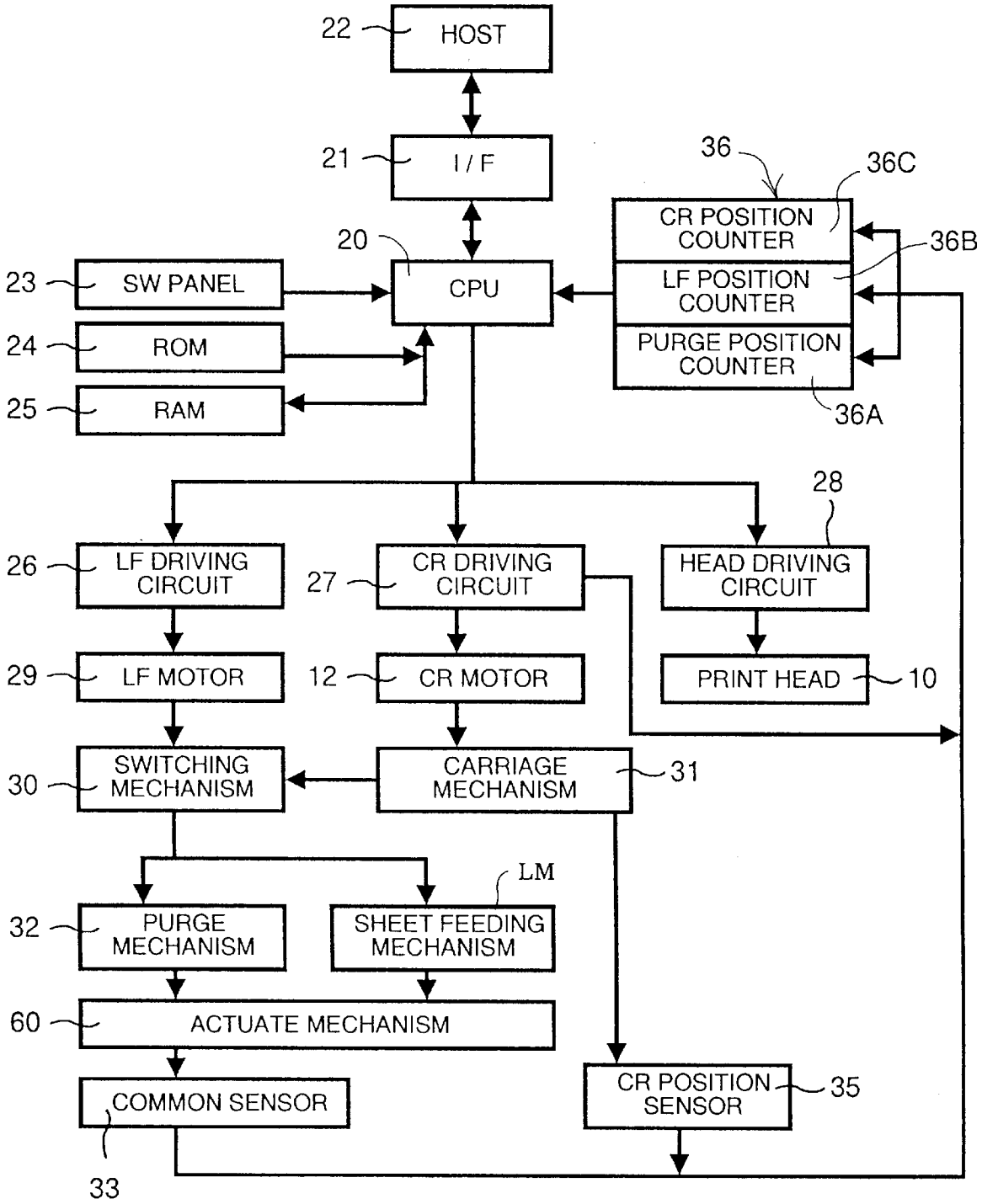
FIG. 4 is a control block diagram showing the ink jet printer.
Figure 5:
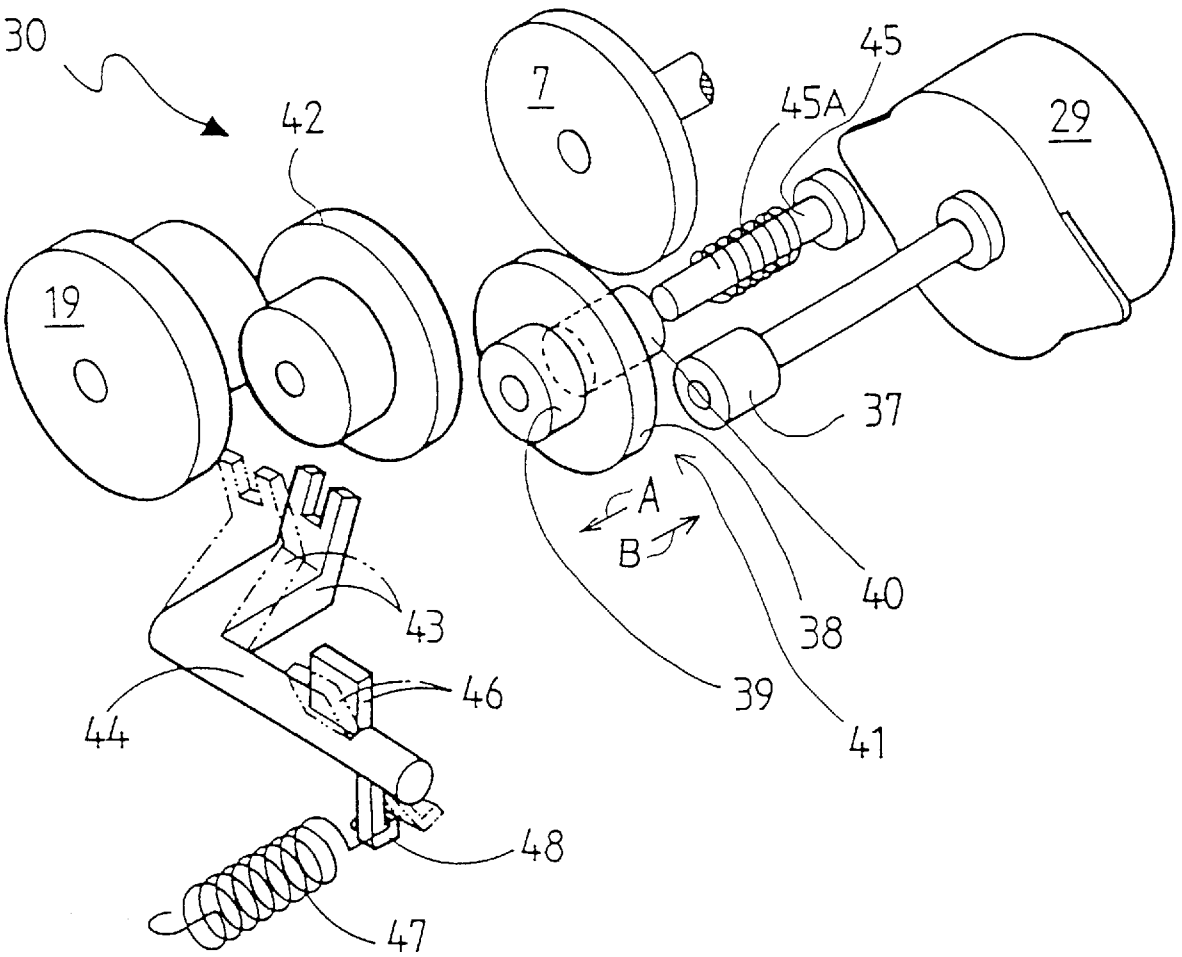
FIG. 5 is a diagram showing the structure of a switching mechanism of a transmission gear.

A cylindrical platen roller 6 is disposed at the rear side of the inner portion of the subframe 4. The platen roller 6 is a part of the sheet feeding mechanism LM and feeds a print sheet supplied from the sheet supply cassette 5 or the manual sheet supply portion 3 while the print sheet faces the print head 10. The platen roller 6 is driven through a platen gear 7 by an LF motor 29 (FIGS. 4 and 5). At the upper side of the platen roller 6 a pressure roller 8 is provided which serves to bring the print sheet into close contact with the platen roller 6.

A carriage 9 is provided in front of the platen roller 6. The carriage 9 has the ink jet type print head 10 mounted thereon and is movable along a carriage shaft 11 which is provided in parallel to the platen roller 6. A CR motor 12 for driving the carriage 9 is disposed on the back surface of the right portion of the subframe 4. The CR motor 12 drives the carriage 9 via a belt 13. A stepping motor or a DC motor is used as the CR motor 12. Along the belt 13 a tape-shaped position gage 14 (timing fence) is provided having a scale and slits, which serves to detect a standby position HP of the carriage 9 and to detect the timing of ink jetting of the print head 10.

A purge mechanism 32, serving as a recovery means for the print head 10, is disposed at the left side of the platen roller 6. The ink jet type print head 10 has a ink-jet failure problem which is caused by the occurrence of bubbles in the ink or by the attachment of deposits on the ink discharge face. To avoid these problems, the purge mechanism 32 is provided for recovering the print head to a normal operating state.

The purge mechanism 32 is provided with a purge device 18 which abuts against an orifice serving as the ink discharge face of the print head 10 to suck the bubbles of the ink from the print head 10 and remove both dust and dried ink from the ink discharge face.

At the tip portion of the purge device 18 is a cap 15 which abuts against the orifice serving as the ink discharge face of the print head 10. The purge device 18 produces a negative pressure using a known type pump 50 when the print head 10 is covered by the cap 15 to suck the defective ink from the print head 10 to recover the print head. The pump 50 of the purge device 18 is driven through a pump cam gear 19, by the LF motor 29.

Figure 3:
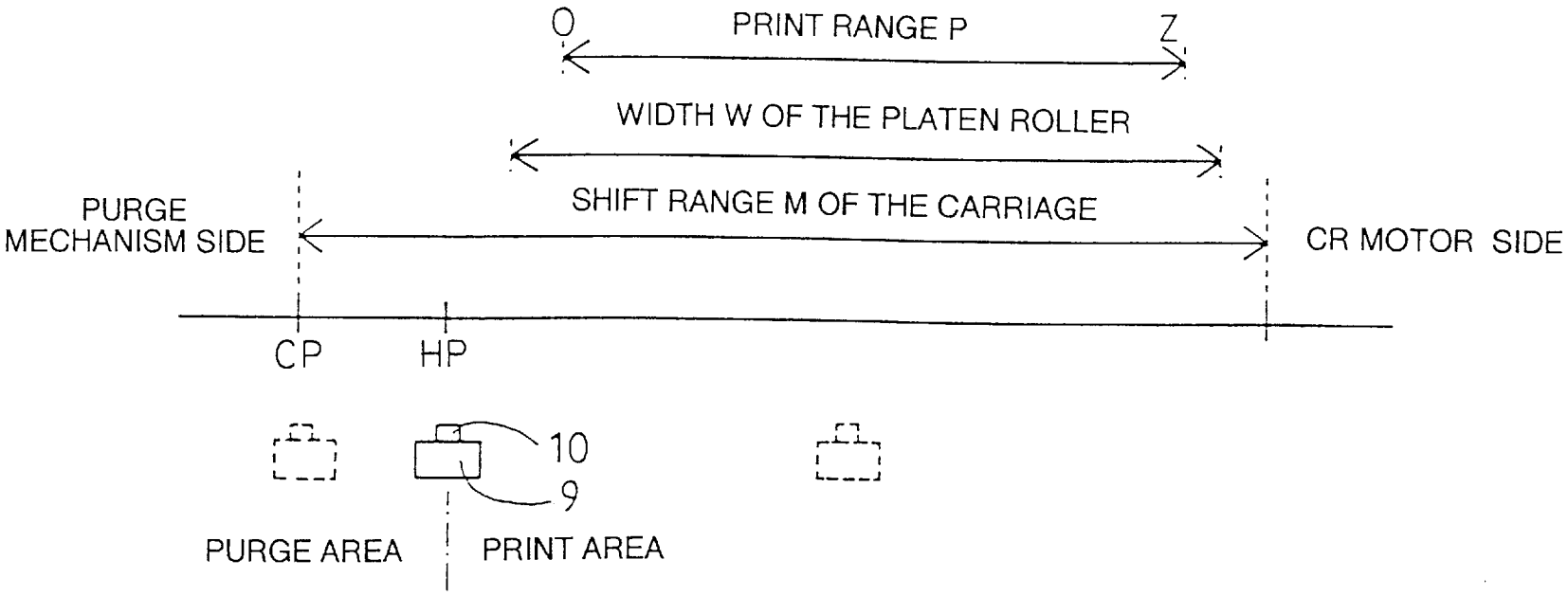
FIG. 3 is a diagram showing the positional relationship in a purge area and a print area within a carriage shift range.

The relationship between a carriage shift range, the position at which the purge device 18 is covered by the cap 15 and a print sheet pass range on the platen roller 6 will be described with reference to FIG. 3. In FIG. 3, the axis represents the position of the carriage 9. The left side of FIG. 3 corresponds to the left side of FIG. 2 (the purge mechanism 32 side) while the right side of FIG. 3 corresponds to the right side of FIG. 2 (the CR motor 12 side). The shift range M of the carriage 9 is set to be larger than the width W of the platen roller 6. A standby position HP of the carriage 9 and a position CP at which the purge device 18 is covered by the cap 15 are set at the left side of the width W. The print sheet passes through the area of the width W. A print range extending from a line head print position 0 to a line end print position Z is within the platen roller width W and the shift speed of the carriage 9 is set to a predetermined print speed in this range. The discharge of a print sheet is carried out in a state where the carriage 9 is located at the standby position HP because the standby position HP is out of the width W and thus the print head 10 is prevented from contacting the leading and trailing edges of the sheet.

Next, the controller of the ink jet printer 1 will be described with reference to the block diagram of FIG. 4. The controller has a CPU 20 as a main element which functions as the calculation processing device.

The CPU 20 is connected through an interface 21 to a host 22 which is an external equipment connected to the print jet printer 1 of this embodiment. The host 22 comprises a personal computer. That is, the ink jet printer 1 receives a print instruction from the host 22, and executes various printing operations according to an instruction.

The CPU 20 is connected to a switch panel 23, a ROM 24 and a RAM 25. The switch panel 23 serves to set and display various parameters, such as a sheet size. The ROM 24 serves to store the programs required to control the ink jet printer 1, for example, to control printing, purging and movement of the carriage 9. The RAM 25 serves to temporarily store print data transmitted from the host 22 and various numerical values required to control the ink jet printer 1.

The CPU 20 controls the driving of the LF motor 29, the CR motor 12 and the print head 10 through the LF driving circuit 26, the CR driving circuit 27 and the head driving circuit 28.

The LF motor 29 drives the purge mechanism 32 and the sheet feeding mechanism LM through the switching mechanism 30. In the switching mechanism 30, the LF motor 29 and the sheet feeding mechanism LM are linked to each other at all times, and the link state between the LF motor 29 and the purge mechanism 32 is switched. The sheet feeding mechanism LM comprises the platen roller 6 and the pressure roller 8. The purge mechanism 32 comprises the purge device 18, the pump 50, and the pump cam gear 19.

The CR motor 12 drives a carriage mechanism 31. The carriage mechanism 31 contains not only the carriage 9, but also the belt 13 and a pair of pullies. The switching operation of the switching mechanism 30 is carried out in connection with the movement of the carriage 9.

The purge mechanism 32 and the sheet feeding mechanism LM are provided with a common sensor through the actuate mechanism 60. The carriage mechanism 31 is equipped with a CR position sensor 35 for detecting a standby position HP of the carriage 9 while facing the position gage 14. The CR position sensor 35 comprises an optical sensor and serves to detect the marking scales and the slits of the position gage 14. These sensors supply detection signals to a counter group 36 provided in the CPU 20.

The common sensor 33 is switched on when the pump 50 is located at its origin position or when the leading edge of a newly supplied print sheet abuts against the common sensor 33, and outputs its on-signal to a purge position counter 36A and an LF position counter 36B of the counter group 36 respectively.

On the basis of the output of the CR position sensor 35 and/or the pulse number of the control signal of the CR motor, the CPU 20 judges the position of the carriage 9, and it identifies a detection target (pump 50 or print sheet) causing the common sensor 33 to output the on-signal on the basis of the judged position of the carriage 9 and an operation status of the ink jet printer 1. The on-signal of the common sensor 33 is used as a criterion for the purge operation of the purge mechanism 32 or as a criterion for the print position control in a longitudinal direction (sheet feeding direction).

The CR position sensor 35 detects the standby position HP of the carriage 9 by using the position gage 14. The standby position HP is painted in a black color on the position gage 14. The position of the carriage 9 after the detection of the standby position HP of the carriage 9 is judged on the basis of a driving pulse which is a control signal of the CR motor 12. This judgment is made on the basis of a count value which is counted by a CR position counter 36C of the counter group 36. The position information is used as a criterion for the print position control in the lateral direction (moving direction of the carriage 9), and also is used as a judgment criterion for the purge operation of the print head 10 or the discharge operation of the printed sheet when the common sensor 33 is switched on.

Next, the switching mechanism 30 will be described with reference to FIG. 5. As described above, the switching mechanism 30 is used to perform a switching operation so that the driving force of the LF motor 29 is transmitted to the appropriate operating mechanism.

FIG. 5 shows a gear group which constitutes the switching mechanism 30. The switching mechanism 30 has an idle gear 41 which is movable in the axial direction of an idle gear shaft 45 (as indicated by arrow A, B) an idle kicker 43 for moving the idle gear 41 in the axial direction of the idle gear shaft 45, and a compression spring 45A for urging the idle gear 41 in the direction as indicated by arrow A. The respective parts are illustrated as being separated from one another to make the understanding clear, however, the respective parts are actually disposed adjacent to one another in the right and left direction (direction parallel to the arrow A) of FIG. 5.

The idle gear 41 comprises three tooth gears, that is, a tooth gear 38 is engaged with the motor gear 37 having the same shaft as the LF motor 29, a tooth gear 40 engaged with the platen gear 7 having the same shaft as the platen roller 6, and a tooth gear 39 which serves to transmit the driving force to the pump cam gear 19 and is selectively engaged with the purge gear 42. The tooth gear 38 and the motor gear 37 are engaged with each other at all times. Likewise the tooth gear 40 and the platen gear 7 are engaged with each other at all times. The link state and the separation state between the tooth gear 39 and the purge gear 42 are selectively switched between one another in accordance with the movement of the idle gear 41 in the shaft (axial) direction.

An idle kicker 43, as well as a kick portion 46 and a spring hook 48 are provided to the rotatable kicker shaft 44. The idle kicker 43 is switched between the states indicated by the solid line and that indicated by the two-dotted chain line. A pull spring 47 is hooked to the spring hook 48 and urges, with its elastically pulling (contracting) force, the idle kicker 43 to the state indicated by the solid line. The elastic pulling force of the pull spring 47 is set to be stronger than the elastic expansion force of the compression spring 45A.

The kick portion 46 is provided at such a position that it projects into the movement range of the carriage 9. Therefore, when the carriage 9 is shifted from the standby position HP (FIG. 3) to the purge position CP, the lower portion of the carriage 9 strikes the kick portion 46 and the kick portion 46 is moved to the position indicated by the two-dotted chain line.

Usually, the kick portion 46, urged by the elastic pulling force of the pull spring 47, is located at the position shown by the solid line. In such a position, the idle kicker 43 presses the idle gear 41 in the direction of arrow B against the urging force of the compression spring 45A. Therefore, the tooth gear 39 of the idle gear 41 is disengaged from the purge gear 42 and the pump cam gear 19 is not driven. With the tooth gear 40 engaged with the platen gear 7, the driving force of the LF motor 29 is transmitted to the platen roller 6.

The purge gear 42 is designed to be disengageable from the idle gear 41 to prevent the reverse rotation of the LF motor 29 from being transmitted to the purge system. That is, the platen roller 6 is rotatable in the reverse direction to position the leading edge of a sheet and, to do so, the LF motor 29 is rotated in the reverse direction. However, if the reverse rotation of the LF motor 29 is transmitted to the purge system, the pump 50 is moved in the reverse direction, applying a positive pressure to cause the ink to counterflow and damage the print head 10.

On the other hand, when the carriage 9 is located at the purge position CP, the idle kicker 43 is kept in the position indicated by the two-dotted chain line and the urging of the pull spring 47 is overcome. Only in this position, the idle gear 41 is pressed in the direction of the arrow A by the compression spring 45A, and the tooth gear 39 is engaged with the purge gear 42. Therefore, the driving force is transmitted to the pump cam gear 19 and the purge mechanism 32 is driven. Even so, the tooth gear 40 and the platen gear 7 are not disengaged from one another and, thus, the platen roller 6 is allowed to be driven.

The common sensor 33 is switched on both when the purge pump is located at its origin position and when the leading edge of a newly-supplied print sheet abuts against the common sensor 33. Therefore, there is provided an actuate mechanism 60 for switching on the common sensor 33 on the basis of both the movement of the pump cam gear 19 and the movement of the leading edge of the print sheet supplied to the platen roller 6. The actuate mechanism 60 as described above will be described in detail with reference to FIGS. 6 to 8.

Figure 6:
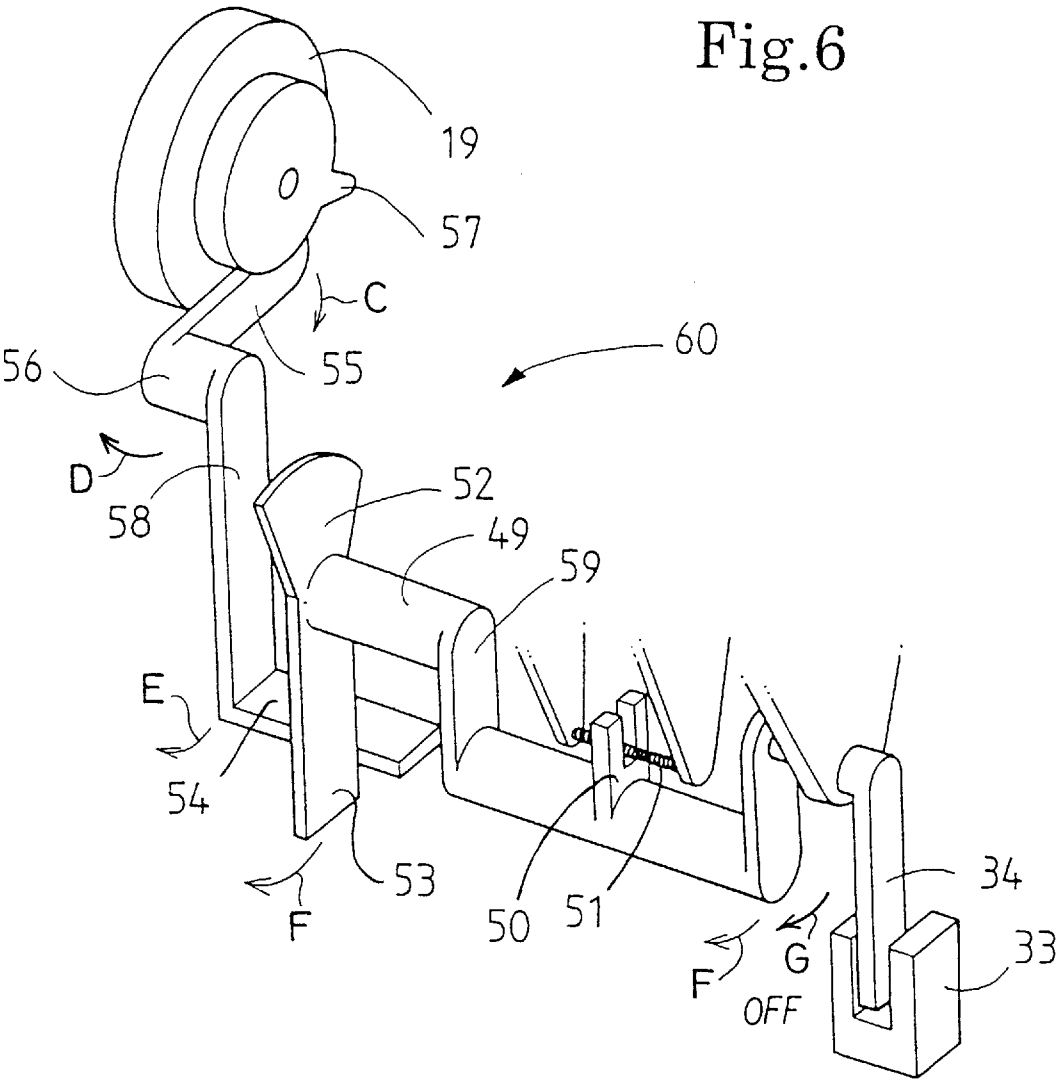
FIG. 6 is a diagram showing the structure of an actuate mechanism of a common sensor.

In FIG. 6, the actuate mechanism 60 has a first actuator 58 for switching on the common sensor 33 when the pump cam gear 19 arrives at a specific position and a second actuator 59 for switching on the common sensor 33 when the leading edge of the print sheet abuts against it.

The first actuator 58 is designed to be rotatable around a shaft portion 56, and it has a cam receiver 55 which is pressed down when the pump cam gear 19 arrives at the specific position. A movement transmission portion 54 presses the second actuator 59 when the cam receiver 55 is pressed down. The pump cam gear 19 is provided with an origin mark which is a projection 57 for pressing against and moving the cam receiver 55 when the pump 50 is located at its origin.

The second actuator 59 is designed to be rotatable around the shaft portion 49, and has a movement receiving portion 53 which is in contact with the movement transmitting portion 54 of the first actuator 58, a sheet detector 52 which abuts against the leading edge of the print sheet, a spring receiver 50 and a shutter 34 which serves to switch on the common sensor 33. The common sensor 33 is designed in an U-shaped form and comprises a photocoupler having a light source and a photosensitive element which are arranged at opposite ends of the U-shape. A returning spring 51 is supported at both ends at a centered position of the spring receiver 50. Normally, the shutter 34 is urged by the elastically contracting force of the returning spring 51 so that the shutter is stopped at a position between the light source and the photosensitive element of the common sensor 33. Thus, normally the common sensor 33 is switched off as shown in FIG. 6.

Figure 7:
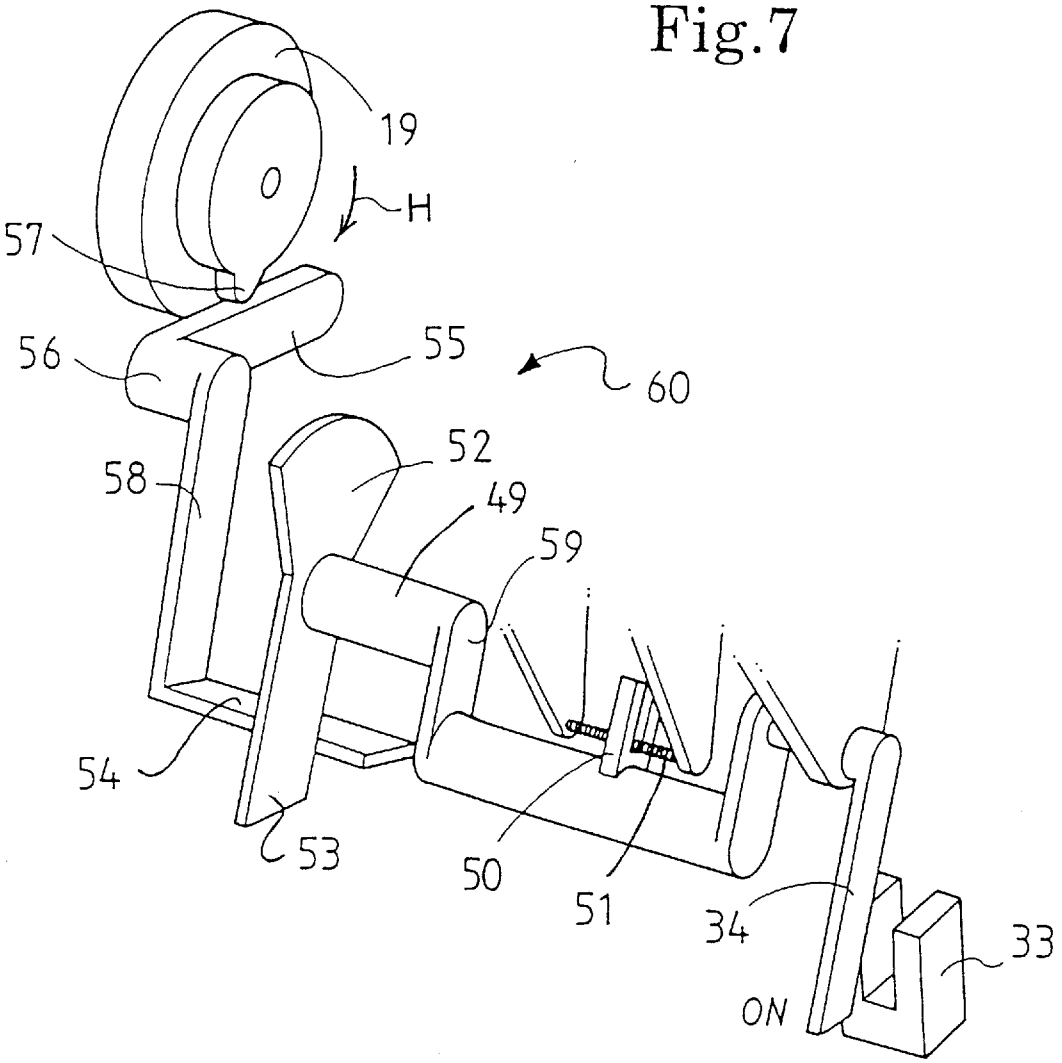
FIG. 7 is a diagram showing a state when the common sensor is switched on the basis of the arrival of the purge device at its origin position.

When the pump cam gear 19 is rotated such that the origin mark 57 comes into contact with the cam receiver 55, the cam receiver 55 is pressed down in the direction C. The first actuator 58 is rotated in the direction indicated by arrow D around the axial line of the shaft portion 56. Therefore, the movement transmitting portion 54 presses the movement receiving portion 53 of the second actuator 59 in the direction indicated by arrow E. As a result, the overall second actuator 59 is rotated in a direction as indicated by arrow F around the axial line of the shaft portion 49. Accordingly, the shutter 34 is moved from between the arms of the common sensor 33 in the direction indicated by arrow G. Thus, light from the light source is incident to the photosensitive element so that the common sensor 33 is switched on. This state is shown in FIG. 7. The returning spring 51 is expanded, as the pump cam gear 19 is rotated in a direction indicated by arrow H in FIG. 7. When the origin mark 57 disengages from the cam receiver 55, the first actuator 58 and the second actuator 59 are rotated in the opposite direction to the direction as described above, and returned to the state shown in FIG. 6 by the contraction of the returning spring 51.

Figure 8:
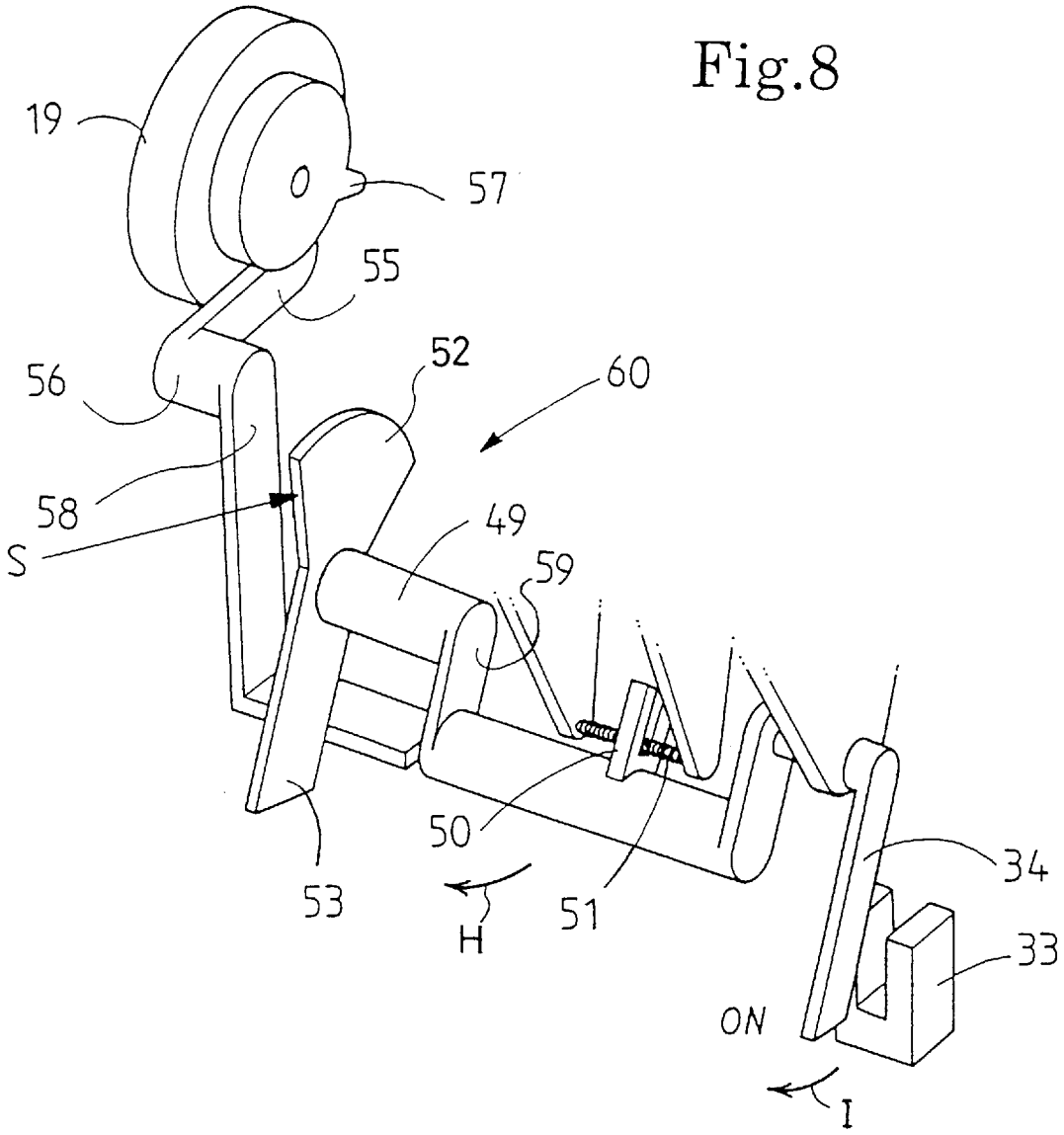
FIG. 8 is a diagram showing a state where the common sensor is switched on by a print sheet.

When a print sheet supplied to the platen roller 6 abuts the sheet detector 52, of the second actuator 59, from a direction as indicated by arrow S of FIG. 8, the sheet detector 52 is pressed in the direction of the arrow S and the second actuator 59 is rotated in the direction of arrow H of FIG. 8 around the axial line of the shaft portion 49. Accordingly, the shutter 34 is moved from between the arms of the common sensor 33 in the direction of arrow I. As a result, the light of the light source of the common sensor 33 (photocoupler) is incident to the photosensitive element to switch on the sensor. This state is shown in FIG. 8.

Since the print sheet presses the sheet detector 52 of the second actuator 59 while the supplied print sheet is loaded on the platen roller 6, the common sensor 33 continues to be switched on. At this time, the returning spring 51 is kept expanded and returns to the state (FIG. 6) only when the print sheet passes over the sheet detector 52.

Next, the operation of the ink jet printer 1 thus structured will be described. The ink jet printer 1 controls the driving of the carriage 9 and the print head 10 according to a command signal from the host 22 to perform a print operation for characters, symbols, or figures on a print sheet while feeding the print sheet supplied from the sheet cassette 5 or the manual sheet supply portion 3 by the platen roller 6.

When the print operation is carried out, a line to be printed on the print sheet is fed by the platen roller 6 until it faces the print head 10 where it is stopped. At this time, the leading edge of the print sheet abuts against the sheet detector 52 in FIG. 6 to rotate the second actuator 59 around the axial line of the shaft portion 49 in the direction of the arrow F, whereby the common sensor 33 is switched on and the on-signal of the common sensor 33 is used as a criterion for the print position control in the longitudinal direction (sheet feeding direction). Thereafter, the carriage 9 is driven at a predetermined print speed by the CR motor 12, and during that time the print head 10 jets the ink according to the command signal to perform the print operation.

When the purge operation of the print head 10 is carried out, the LF motor is rotated to where the carriage 9 is located at the purge position CP (FIG. 3), thereby rotating the pump cam gear 19 through the switching mechanism 30. When the common sensor 33 is switched on by the origin mark 57, the pump cam gear 19 is rotated by a predetermined amount, on the basis of the switch-on of the common sensor 33, and the ink in the print head 10 is sucked under the negative pressure produced by the purge pump, whereby the print head 10 is recovered to its excellent ink jetting state.

The actual control routine of the ink jet printer 1 will be described with reference to the flowchart of FIG. 9.

First, it is assumed that the state of the ink jet printer 1 is just after the completion of the printing of one page. After that, the ink jet printer 1 carries out a purge operation or a further print operation in accordance with an instruction from the host 22.

In this state, in step S1, the stop position of the carriage 9 is checked on the basis of the output of the CR position sensor 35, and it is judged whether the position is the standby position HP (FIG. 3) because the position of the carriage 9 varies in accordance with the final print position on the final print line. When the carriage 9 is stopped at a position other than the standby position HP (S1:No), in step S2 the carriage 9 is moved to the standby position HP and then the process goes to step S3. This is done because the printed sheet is still loaded on the platen roller 6 and it must be discharged. If the carriage 9 is stopped at the standby position HP in step S1 (S1:Yes), the process directly goes to step S3. In step S3, it is judged whether the common sensor 33 is switched on. If the common sensor 33 is switched on (S3:Yes), the process goes to step S4.

At this time, the carriage 9 is located at the standby position HP, that is, at a position other than the purge position. Thus, the idle gear 41 and the purge gear 42 are disengaged from each other through the switching mechanism 30 and the pump cam gear 19 cannot be driven. Therefore, the CPU 20 judges that the switch-on operation of the common sensor 33 is based on the print sheet. That is, it judges that the printed sheet is still loaded on the platen roller 6. Accordingly, in step S4, the LF motor 29 is driven in a forward direction to feed and discharge the print sheet when the common sensor 33 is switched off. The process goes to step S5. If the common sensor 33 is not switched on in step S3 (S3:No), the process directly goes to step S5.

In step S5, the LF motor 29 is driven in a forward direction by a predetermined amount because there is a time lag between the time when the trailing edge of the print sheet passes over the sheet detector 52 and the common sensor 33 is switched off and the time when the printed sheet is completely separated from the platen roller 6. Accordingly, the print sheet is completely discharged, and the platen roller 6 is set to an empty (no-sheet) state.

In this case, the print sheet is completely discharged. Since the forward rotation of the LF motor 29 is also transmitted to the platen roller 6 when the purge operation, as described later is carried out, the prior print sheet is beforehand discharged so that it is prevented from making an unexpected motion. The carriage 9 is located at the standby position HP and the print head 10 is located out of the pass range of the print sheet. Thus, the print head 10 never contacts the trailing edge of the sheet.

Thereafter, in step S6 it is judged whether a print instruction is made. If a print instruction is made (S6:Yes), the process goes to step S14 to supply a new print sheet onto the platen roller 6 and execute the print operation. The print operation is carried out by driving the platen roller 6 and the print head 10 on the basis of the timing at which the print sheet is loaded onto the platen roller, the carriage 9 is moved within the print range P and the common sensor 33 is switched on. If no print instruction is made (S6:No), it is judged in step S7 whether a purge instruction is made. If the purge instruction is made (S7:Yes), the process goes to step S8. If no purge instruction is made (S7:No), the process returns to step S6 to wait for an instruction. If the print instruction or the purge instruction is made before the forward rotation of the LF motor 29 in step S5 is completed, the instruction is suspended and the process goes to the steps after the completion of step S5. In step S8, the carriage 9 is moved to the purge position CP to perform the purge operation. At this time, in the switching mechanism 30, the kick portion 46 is contacted by the carriage 9, whereby the idle gear 41 is linked to the purge gear 42.

In step S9, it is judged whether the common sensor 33 is switched on. If the common sensor 33 is not switched on (S9:No), in step S10 the LF motor 29 is driven in the forward direction until the common sensor 33 is switched on, and then process goes to step S11. If the common sensor 33 is switched on in step S9 (S9:Yes), the process directly goes to step S11.

At this time, as the carriage 9 is located at the purge position CP and the sheet has been discharged from the platen roller 6 in steps S4 and S5, the CPU 20 judges that the switch-on operation of the common sensor 33 is based on the origin mark 57 of the purge cam 19. Therefore, in step S11, the LF motor 29 is forwardly driven by an amount corresponding to one purge operation, and the print head is recovered by the purge device 18.

Thereafter, in step S12, the carriage 9 is moved to and kept at the standby position HP. At this time, in the switching mechanism 30, the contact with the kick portion 46 by the carriage 9 is released, and the idle gear 41 is disengaged from the purge gear 42. Thereafter, if the print instruction is made in step S13 (S13:Yes), the process goes to step S14 to supply a new print sheet onto the platen roller 6 and perform the print operation, thereby completing the flow of the print operation.

As described above in detail, according to the ink jet printer 1 of this embodiment, when the carriage 9 is moved to the recovery position CP, the kick portion 46 of the switching mechanism 30 is contacted by the carriage 9, and the idle gear 41 is linked to the purge gear 42. On the other hand, when the carriage 9 is moved away from the recovery position CP, the idle gear 41 is disengaged from the purge gear 42. Therefore, the purge device 18 is not driven when the carriage 9 is located at the standby position HP and within the print range P.

Furthermore, when the purge pump of the purge device 18 arrives at the origin position, the common sensor 33 is switched on through the first actuator 58 by the origin mark 57 of the pump cam gear 19. Therefore, when the common sensor 33 outputs a switch-on signal in a state where the carriage 9 is located at the recovery position CP, the purge device 18 is driven on the basis of the switch-on signal, and the recovery operation of the print head 10 is carried out with high precision.

On the other hand, when the carriage 9 is located within the print range P, the print operation is carried out on the basis of the on-signal which is output from the common sensor 33 through the second actuator 59 because the print sheet is supplied onto the platen roller 6, so that the print position precision is high.

Furthermore, when the print operation of one page is completed, the carriage 9 is moved to the retraction position HP to drive the platen roller 6 at that position until the on-signal, which is output from the common sensor 33 through the second actuator 59 due to the print sheet, is switched off, and the platen roller is further driven by a predetermined amount to discharge the printed sheet. At this time, the carriage 9 is located at the retraction position HP and out of the print sheet path range so that the carriage 9 does not contact the trailing edge of the print sheet.

Further, when the carriage 9 is moved to the recovery position CP to perform the recovery operation of the print head 10, it necessarily passes over the retraction position HP to discharge the sheet before the carriage 9 arrives at the recovery position CP. Therefore, even when the rotation of the LF motor 29 is transmitted to the platen roller 6 during the recovery operation of the print head 10, the print sheet is not moved inadvertently.

The invention is not limited to the above embodiment, and various improvements and modifications may be made without departing from the subject matter of the invention.

For example, in the above-mentioned embodiment, the detection of the position of the carriage 9 is performed using the position gage 14 for only the standby position HP, and thereafter the position detection is carried out using the driving signal of the CR motor 12. However, the position detection of the carriage 9 may be performed using no driving signal of the CR motor 12, but using only the scales and slits of the position gage 14.

What is claimed is:

1. An ink jet print recording apparatus which has an ink jet type print head for jetting ink from an ink discharge port onto a print medium, a feeding roller for feeding the print medium, a carriage which is equipped with a print head and is movable in parallel to the feeding roller, carriage position judging means for judging the position of the carriage, recovery means for sucking the ink from the ink discharge port of the print head to recover the print head, and a driving motor for driving the feeding roller and the recovery means, comprising:

driving switching means for linking the driving motor to the recovery means when the carriage is moved to a recovery position at which the recovery means performs a recovery operation on the print head, and separating the driving motor and the recovery means from each other when the carriage is moved away from the recovery position;

a sensor for generating reference signals for a recovery operation of the print head and a print medium feeding operation of the feeding roller;

a first transmission member for switching on the sensor when the recovery means is located at the origin position;

a second transmission member for switching on the sensor through the print medium when the print medium is supplied to the feeding roller;

recovery control means for actuating the driving motor on the basis of a signal from the sensor which is switched on by the first transmission member when the carriage is located at the recovery position, thereby performing the recovery operation of the print head; and print control means for actuating the driving motor and the print head on the basis of a signal from the sensor which is switched on by the second transmission member when the carriage is located at a print position at which the print medium is printed.

2. The ink jet print recording apparatus as claimed in claim 1, further comprising sheet discharge control means for actuating the driving motor until the signal from the sensor is switched off to discharge the print medium from the feeding roller when the carriage is moved to a standby position at which the carriage waits for an instruction.

3. An ink jet printing apparatus, comprising:

a frame;

a platen assembly mounted in the frame and including a platen shaft, a platen mounted on the platen shaft and a platen gear mounted at an end of the platen shaft;

a print head assembly mounted in the frame and including a carriage guide parallel to the platen, a carriage mounted for reciprocal movement to the carriage guide, a print head mounted to the carriage and driving means for driving the carriage;

a drive motor;

a recovery mechanism for cleaning the print head;

a gear assembly linking the drive motor to the platen gear and for selectively linking the drive motor to the recovery mechanism; and a single sensor for determining a print medium feed state and a recovery state based upon a position of the carriage.

4. The ink jet print recording apparatus as claimed in claim 3, further comprising sheet discharge control means for actuating the drive motor until a signal from the single sensor is switched off to discharge a print medium from the platen when the carriage is moved to a standby position at which the carriage waits for an instruction.

5. The ink jet printing apparatus as claimed in claim 3, wherein the sensor comprises:

a first actuator engaged with the recovery mechanism;

a second actuator having a first actuator movement transmission portion and a sheet contact portion; and a shaft portion providing an axis of rotation for the second actuator.

6. The ink jet printing apparatus as claimed in claim 5, wherein the sensor further comprises:

a shutter mounted to the shaft and separated from the second actuator, the sensor in a cooperative relationship with the shutter for outputting a detection signal.

7. The ink jet printing apparatus as claimed in claim 5, wherein the sensor outputs the detection signal when the second actuator is activated.

8. The ink jet printing apparatus as claimed in claim 7, further comprising a carriage position detection sensor.

9. The ink jet printing apparatus as claimed in claim 8, further comprising an evaluator for determining whether the sensor signal indicates a print medium feed operation or a recovery operation is in progress based upon receipt of the sensor signal and a position signal from the carriage position detection sensor.

10. The ink jet printing apparatus as claimed in claim 9, wherein the evaluator determines whether the carriage is at a home position based on the position signal from the carriage position detection sensor and the carriage is at one of a print area and a recovery area based upon receipt of the position signal from the carriage position detection sensor.

11. The ink jet printing apparatus as claimed in claim 9, wherein the evaluator determines whether the sensor signal represents the recovery operation or the print medium feed operation based on the position signal.

12. The ink jet printing apparatus as claimed in claim 5, wherein the recovery mechanism comprises:

sucking means for drawing ink from the print head and removing particles adhered to a face of the print head;

a sucking gear for driving the sucking means; and an origin mark mounted to the sucking gear and providing a camming surface for engaging the first actuator.

13. The ink jet printing apparatus as claimed in claim 12, wherein the first actuator comprises:

a cam receiver;

an L-shaped contact portion; and a shaft portion defining an axis of rotation, the cam receiver and the L-shaped contact portion mounted to the shaft portion such that the cam receiver and a side leg of the L-shaped contact portion are transverse to one another.

14. The ink jet printing apparatus as claimed in claim 13, wherein a base leg of the L-shaped contact portion of the first actuator contacts the first actuator movement transmission portion of the second actuator.

15. The ink jet printing apparatus as claimed in claim 6, wherein the sensor comprises:

a U-shaped body having a base and an arm extending from each end of the base;

a light source in one arm directing a light beam toward the other arm; and a light beam detector in the other arm.

16. The ink jet printing apparatus as claimed in claim 15, wherein the shutter passes between the arms of the common sensor to interrupt the light beam, the detection signal being output when the shutter is displaced from between the arms.

17. The ink jet printing apparatus as claimed in claim 5, further comprising a centering means for returning the second actuator to a neutral position.

18. The ink jet print recording apparatus as claimed in claim 17, further comprising sheet discharge control means for actuating the drive motor until the signal from the sensor is switched off to discharge the print medium from the feeding roller when the carriage is moved to a standby position at which the carriage waits for an instruction.

19. The ink jet print recording apparatus as claimed in claim 8, further comprising:

a carriage drive motor;

an evaluator for determining a carriage position based upon a one of a position output of the carriage position detection sensor and a combination of a home position output from the carriage position detection sensor and a pulse count and rotation direction of the carriage drive motor.

* * * * *